US007055630B1

(12) United States Patent
Burton

(10) Patent No.: US 7,055,630 B1
(45) Date of Patent: Jun. 6, 2006

(54) ERECTION OF SIGNS USING A SINGLE VEHICLE

(76) Inventor: Jones Wayne Burton, 155 Tom's Creek Bluff Rd., Pilot Mountain, NC (US) 27041

( * ) Notice: Subject to any disclaimer, the term of this patent is extended or adjusted under 35 U.S.C. 154(b) by 254 days.

(21) Appl. No.: 10/793,048

(22) Filed: Mar. 4, 2004

(51) Int. Cl.
*E21B 3/02* (2006.01)

(52) U.S. Cl. ..... 175/203; 175/118; 173/28

(58) Field of Classification Search ..... 173/28, 173/42, 185, 192; 175/23, 118, 122, 203, 175/39
See application file for complete search history.

(56) References Cited

U.S. PATENT DOCUMENTS 3,073,397 A 1/1963 Balogh
3,576,218 A * 4/1971 Lisenby ..... 173/28
4,124,081 A * 11/1978 Deike ..... 173/28
4,448,269 A 5/1984 Ishikawa et al.
4,485,570 A 12/1984 Sonerud
5,094,302 A 3/1992 Back
5,377,767 A 1/1995 Briggs
5,417,292 A 5/1995 Polakoff
5,556,217 A 9/1996 Deyo et al.
5,931,614 A 8/1999 Meyen et al.
5,944,452 A * 8/1999 Reinert, Sr. ..... 405/232
6,129,163 A 10/2000 Hamilton et al.
6,223,838 B1 5/2001 Dengel et al.
6,296,068 B1 10/2001 Frederick
6,533,048 B1 3/2003 Groce, Jr. et al.
6,619,413 B1 9/2003 Hamilton et al.

* cited by examiner

*Primary Examiner*—Frank S. Tsay
(74) *Attorney, Agent, or Firm*—Robert W. Pitts

(57) ABSTRACT

A truck mounted crane is equipped with an earth boring bit apparatus which can be attached to the end of a crane boom to excavate holes prior to the erection of signs or other elevated pole mounted structures. The earth boring bit apparatus includes a earth boring bit attachable to a gearbox which may include an extension shaft to permit its use on the crane. The crane also includes high capacity hydraulic lines suitable for actuating the earth boring bit, which also includes a drum for collecting earth as the hole is bored so that the crane can be used to remove the debris as part of the same operation in which the hole is bored.

20 Claims, 7 Drawing Sheets

ERECTION OF SIGNS USING A SINGLE VEHICLE

BACKGROUND OF THE INVENTION

1. Field of the Invention

This invention relates to the erection of outdoor signs or other elevated structures that are mounted on poles or posts. This invention also relates to truck mounted cranes in which earth boring bits can be transported on the truck and are attachable to the crane for boring holes in which the poles or posts are to be anchored.

2. Description of the Prior Art

Commercial truck mounted cranes with hydraulic booms are typically employed to erect large outdoor signs having a height of four feet or greater. These signs are commonly employed in front of commercial establishments, and their height allows potential customers to easily identify the business or its location. Since these signs are erected on site it is necessary to employ mobile trucks with cranes to erect the signs. However, conventional crane mounted trucks do not have the capability of performing all of the tasks needed to erect these signs. One critical shortcoming is that conventional truck mounted cranes cannot be employed to drill the holes in the earth or in pavement in which these signs will be erected. Normal practice requires the use of a separate vehicle, such as a line truck, that is equipped with a earth boring bit of the type suitable for drilling these holes. Since the site at which the sign is to be located may be remote from the facilities of an operator of a commercial truck mounted crane, it is often necessary to secure the services of a local contractor, with appropriate equipment, to drill the necessary holes. Quite often this can result in a significant delay for the operator of the truck mounted crane, especially when the site may be in a different state or can be quite remote from his facilities. The crane operator is then at the mercy of other contractors, with whom he may not be familiar, or who may have a significant backlog. This can result in significant delays and add significant cost.

U.S. Pat. No. 6,533,048 discloses an earth boring bit driven by a hydraulic motor which is connected to a boom on a mobile machine or vehicle. This earth boring bit includes a cylindrical drum in which earth or other debris from a bored hole is retained as rotating cutting teeth on the base of the drum cut into the earth or pavement. This drum serves to collect the debris, which can then be removed from the hole to a neighboring collection point or container. When the bit has been moved to the collection location by rotation of the boom on which it is mounted, the base of the drum can be allowed to swing open, emptying the debris removed from the hole. This earth boring bit can be used instead of augers or other boring bits, which require a separate implement to remove earth or other debris from the bored hole. This earth boring bit can be used on a vehicle with a swinging hydraulic boom or on tractors, skid steer backhoes or other mobile machines or vehicles having a stationary boom. This earth boring bit is intended for use on line trucks or other equipment that is normally used at least in part for earth moving operations, such as drilling holes, and includes a hydraulic system having sufficient capacity for operating the earth boring bit. In particular, this earth boring bit is intended for use with vehicles having a boom capable of delivering sufficient hydraulic fluid to the hydraulic motor suspended from the end of the boom above this earth boring bit.

SUMMARY OF THE INVENTION

According to this invention, a method of erecting a post structure, such as an outdoor sign, which can have a height in excess of ten feet, uses a single crane apparatus including a hydraulic system for conventional use on the crane, which is connected to a source of hydraulic fluid. The method includes the following steps. An earth boring bit is connected to the source of hydraulic fluid through hydraulic lines extending from the base to the end of the single crane apparatus. The earth boring bit is hydraulically actuated through the hydraulic line to excavate a hole for erection of the post structure. Earth is removed from the hole by employing the crane to lift the earth boring bit from the hole. The earth boring bit is disconnected from the hydraulic line, which is disconnectable from the source of hydraulic fluid adjacent the base of the crane so that the hydraulic pressure is available for other functions of the crane. The post structure is erected in the evacuated hole with the crane, so that only a single crane needs to be employed to both evacuate a hole receiving the post structure and to erect the post structure anchored in the evacuated hole.

A method of erecting an outdoor sign at a site distant from an operator's premises using only a single truck equipped with a crane apparatus can also include the following steps. An earth boring bit apparatus is transported on the truck to the site at which the outdoor sign is to be erected. At the site, the earth boring bit apparatus is removed from the truck using the crane. The earth boring bit apparatus is connected to hydraulic lines on the crane. The earth boring bit apparatus is positioned using the crane apparatus to excavate a hole in which the sign is to be placed. The hole is excavated using the earth boring bit apparatus and employing the crane to transport debris from the hole. The earth boring bit apparatus is then disconnected from the crane apparatus and the hydraulic lines after the hole has been excavated. The outdoor sign is erected by positioning the steel or other support structure, on which the outdoor sign is to be mounted, in the excavated hole using the same crane apparatus employed with the earth boring bit. Separate mobile equipment, other than the truck equipped with the crane apparatus and the earth boring bit apparatus, is not needed at the site.

A truck suitable for erecting a sign or other elevated structure according to these methods can include the following components: A crane mounted on the truck includes a hydraulic system with hydraulic lines extending from adjacent the base to the top or remote end of the crane. An earth boring bit is transportable on the truck separate from the crane. A gearbox apparatus, including an extension segment, is also transportable on the truck separate from the crane and the earth boring bit apparatus. The gearbox can be attached between the hydraulic system and to the earth boring bit, so that the earth boring bit may be rotated to excavate a hole in which the outdoor signs are to be erected. The crane can be used to assemble the gearbox to the earth boring bit apparatus.

This method and apparatus reduces the need for the operator of the truck to obtain assistance of others, such as operators of line trucks equipped to excavate holes, as he assembles signs at remote jobsites. The earth boring bit can be driven by the hydraulic system on the truck mounted crane when the earth boring bit is mounted on the crane. The crane and the earth boring bit can also be used to remove the earth or other debris created as holes are bored, eliminating the need to manually remover the earth or debris or to use separate equipment for earth removal. The operator of a truck mounted crane equipped in this manner is therefore less dependent on others and can avoid costly delays in completing his task, especially at remote locations with which the operator may be unfamiliar.

BRIEF DESCRIPTION OF THE DRAWINGS

FIG. 3A shows the bit in the closed position and FIG. 3B shows the bit in the open or dumping position.

DETAILED DESCRIPTION OF THE PREFERRED EMBODIMENT

Figure 1:
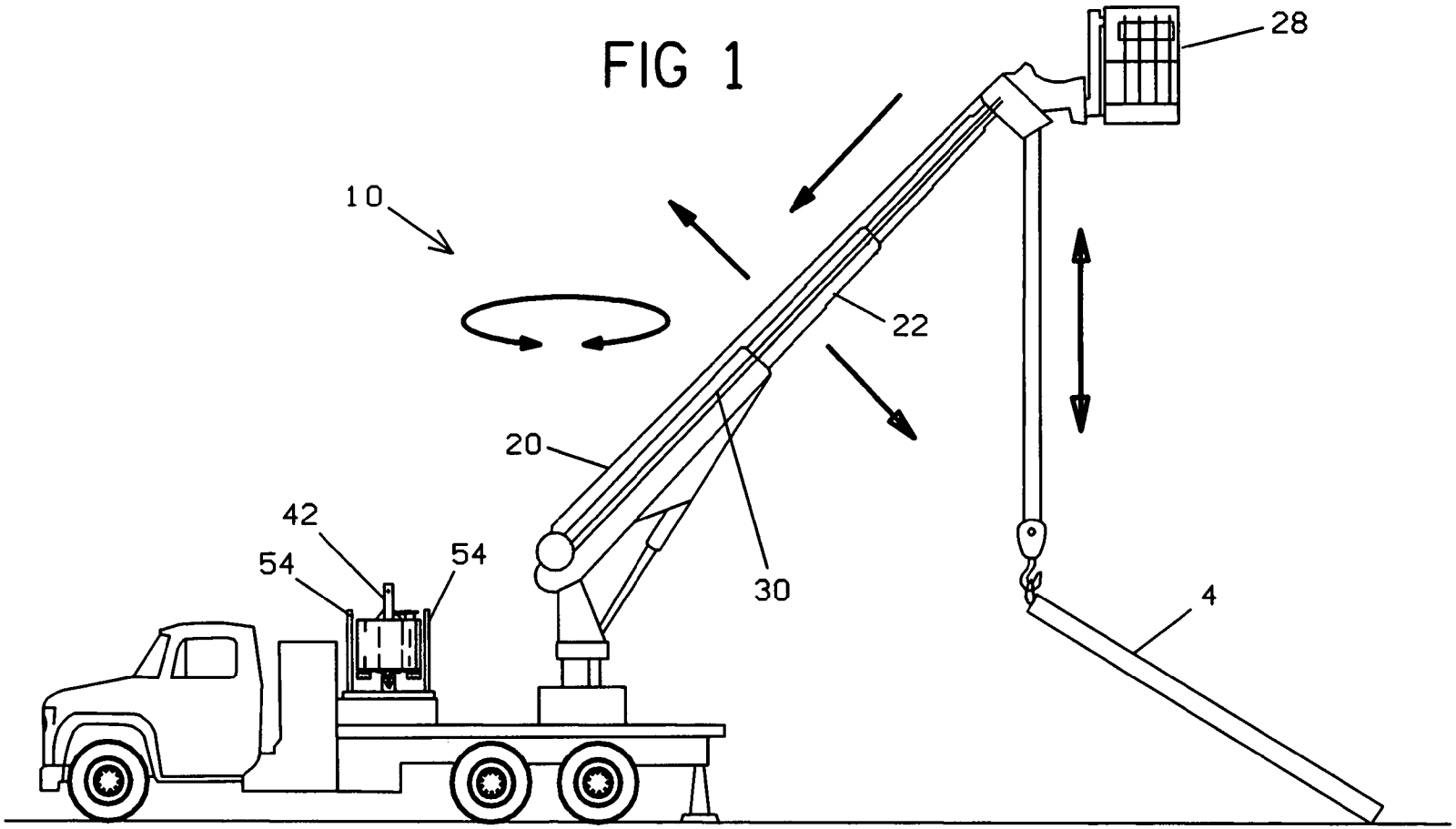
FIG. 1 is a view of a truck mounted crane apparatus, or sign truck, equipped to erect an outdoor sign or other elevated structure, and to excavate holes in which the sign will be positioned. The crane is shown partially lifting a pole or structural support for mounting a sign.
Figure 2:
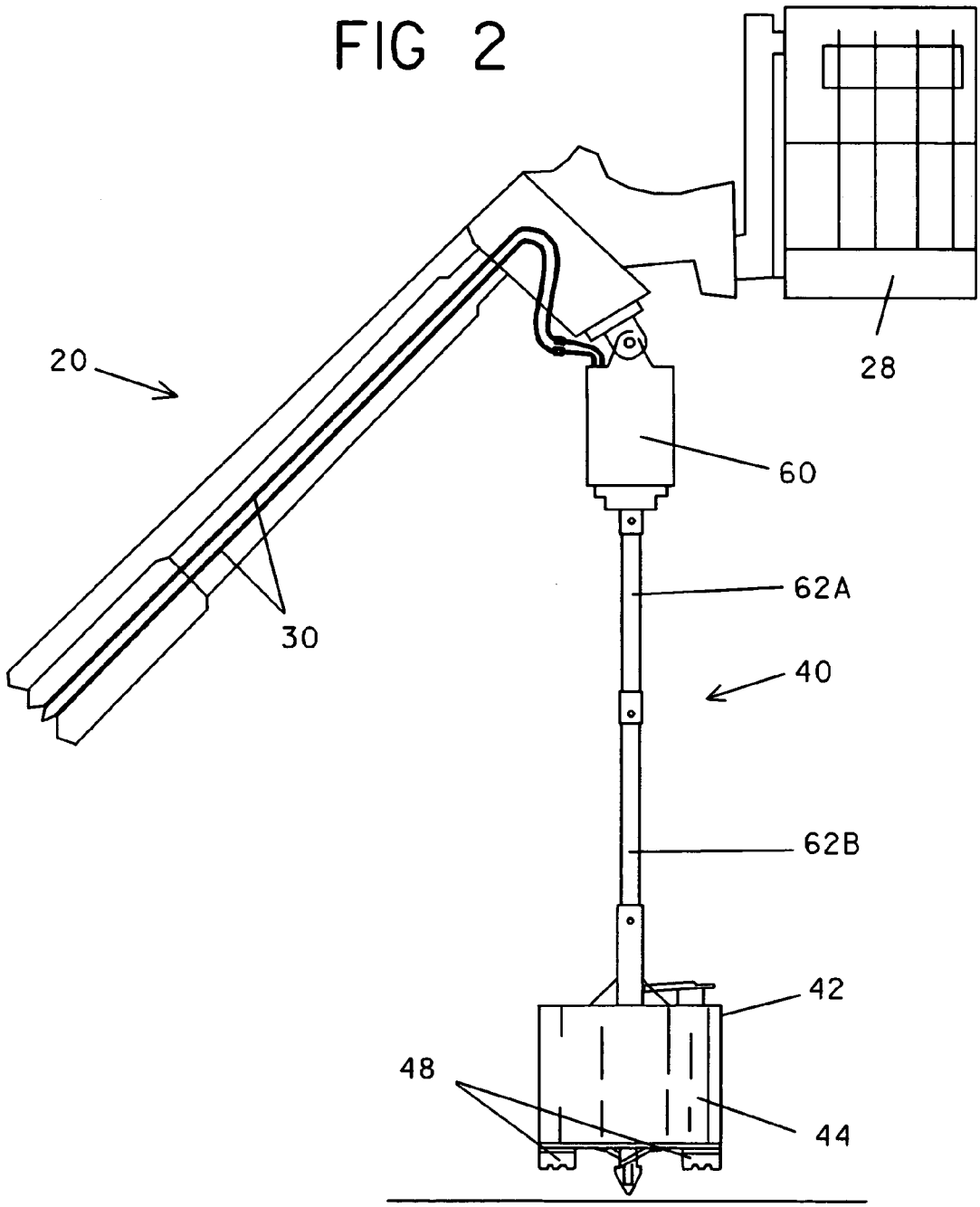
FIG. 2 is a view of an earth boring bit and gear box mounted on one end of a crane or boom, mounted on the truck shown in FIG. 1, in position to excavate a hole for erecting a sign.
Figure 3A:
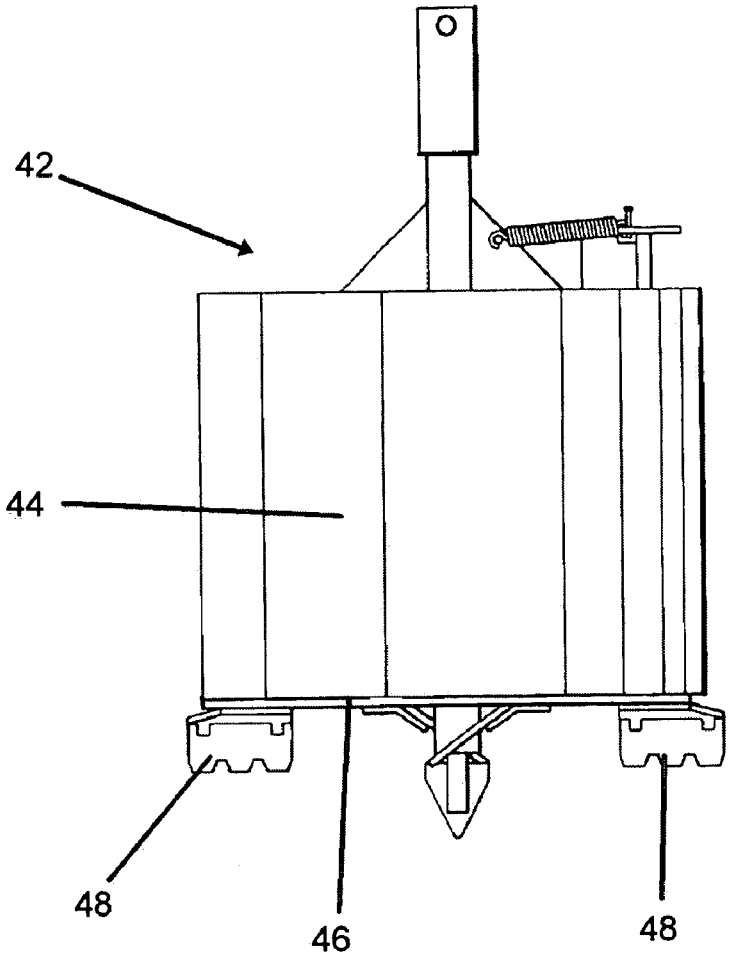
FIG 3A PRIOR ART
FIGS. 3A and 3B are views of a prior art earth boring bit used with the crane as shown in FIG. 2.
Figure 3B:
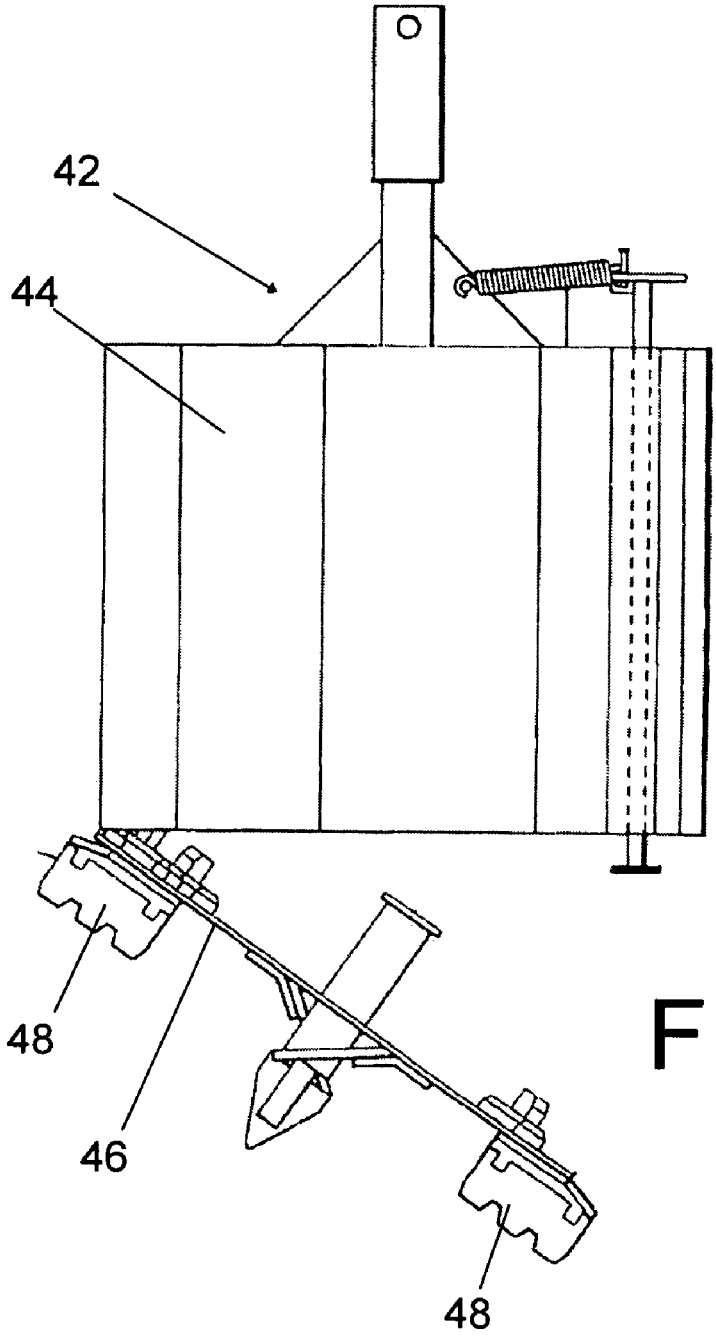
FIG 3B PRIOR ART
Figure 4:
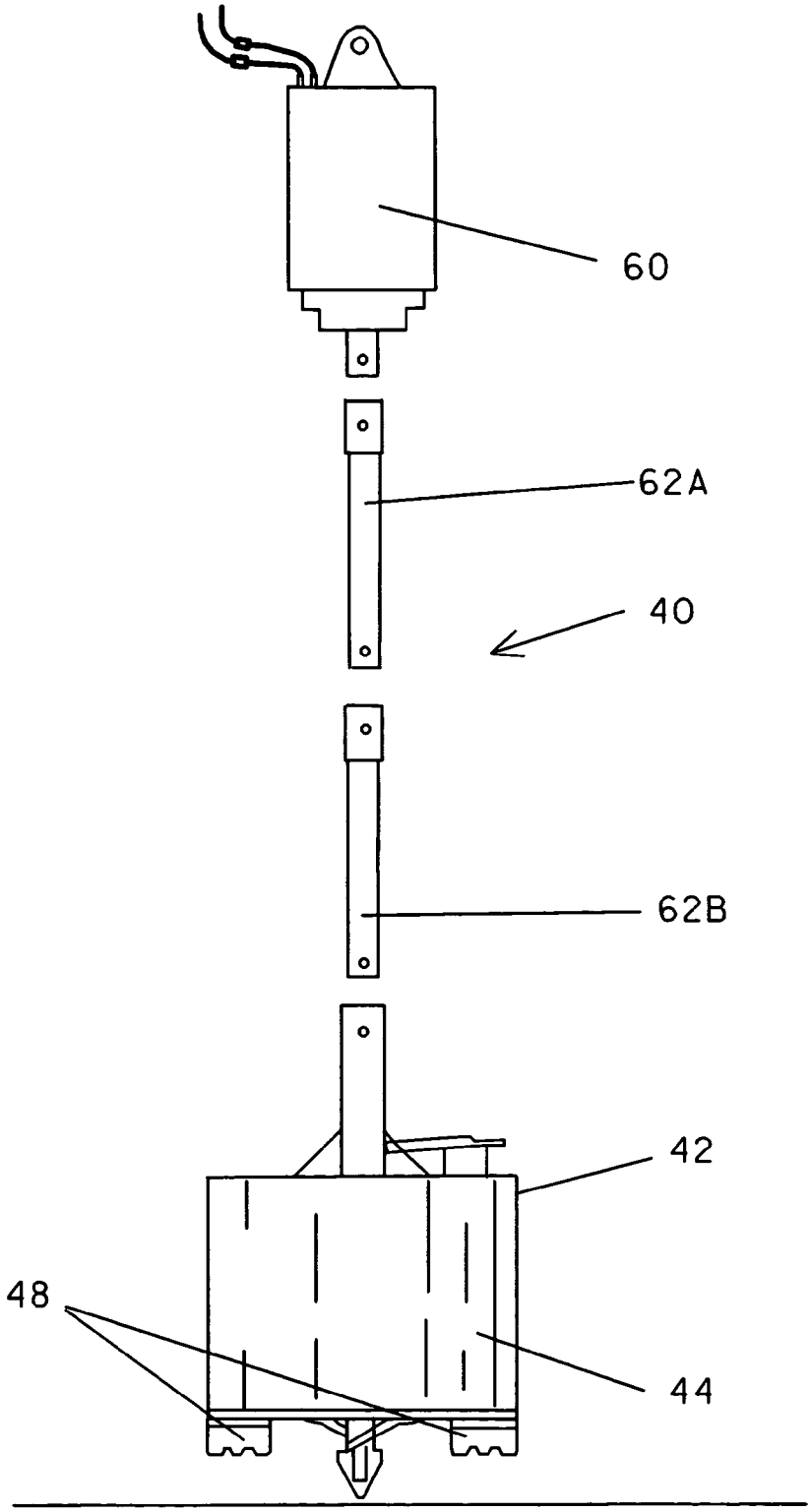
FIG. 4 is a view of the gear box, with an extension segment, employed with the earth boring bit in the manner shown in FIG. 2.

FIG. 1 shows an aerial ladder crane comprising a unit providing crane capability and aerial ladder capability in one integral unit, which may be used for hoisting loads and for access or as a working platform, and is commonly referred to as a sign crane truck 2. This mobile apparatus can be used for erecting outdoor signs 2 on poles 4 or other elevated structures including posts or poles anchored in hole. In addition to providing means for hoisting and erecting these elevated structures, the sign truck 2 also includes means for excavating holes 6 in earth, pavement or other substructures.

The truck 2 includes a crane apparatus 20, which is permanently mounted on the bed of the truck 2, and an earth boring bit apparatus 40 that is carried and transported on the truck 2 and can be attached to the crane apparatus 20 at an on site location. The earth boring bit apparatus 20 includes an earth boring bit 42 and a gearbox 60 which can be attached on site to a hydraulic system, which is part of the truck 2.

The preferred embodiment of the earth boring bit 42 is described in further detail in U.S. Pat. No. 6,533,048, which is incorporated herein by reference. This earth boring bit 42 includes a cylindrical drum 44, which includes a pivoting base 46. Cutting teeth 48 on the base 48 dig into the earth as the earth boring bit 42 is rotated about the axis of revolution of the cylindrical drum 44. The earth or debris or other residue created by the rotating bit teeth 48 is deposited in the cylindrical drum 44 while in the closed position. After a hole has been excavated to a desired depth, or to the depth at which this earth boring bit 42 can reach, the bit 42, with the drum base 46 in the closed position, is removed from the excavated hole. This earth boring bit 42 can then be moved to another position spaced from the hole and the drum base 46 can be released in the manner described in U.S. Pat. No. 6,533,048 to deposit the earth or other excavated debris at a location remote from the hole or in a separate container which can be hauled away from the job site.

The crane 20 mounted on sign truck 10 is hydraulically operable by a hydraulic system that is part of the sign truck. This crane 20 is rotatable about its base and segments of the crane boom 22 are telescoped permitting the crane 20 to reach heights sufficient to erect most conventional outdoor signs having a height of ten feet or more. Crane 20 includes a basket or working platform 28 located on the end of the distal boom section. A pair of hydraulic lines 30, attached to one side of the outer crane boom, has sufficient capacity to power this earth boring bit apparatus. In the preferred embodiment of this invention, hydraulic lines 30 are operable at a pressure of 2300 psi. with a flow rate of 22 gal/min. Standard hydraulic connectors are located at opposite ends of second hydraulic line 30. The hydraulic lines 30 can therefore be attached near the base of the crane 20 to the same hydraulic connectors that normally hydraulic lines for manipulating the hoist or load line or cable which is mounted on the crane and is attached to a load adjacent the end of the crane. In the preferred embodiment of this invention, the hydraulic lines that are used to manipulate the hoist or load line or cable are disconnected when the second hydraulic lines are connected because operation of the earth boring bit is not dependent upon this line or cable. The hydraulic connectors on the other end of the hydraulic lines 30 will permit attachment and detachment of the earth boring bit apparatus 40 to the source of hydraulic pressure to power the earth boring bit apparatus 40.

Figure 5:
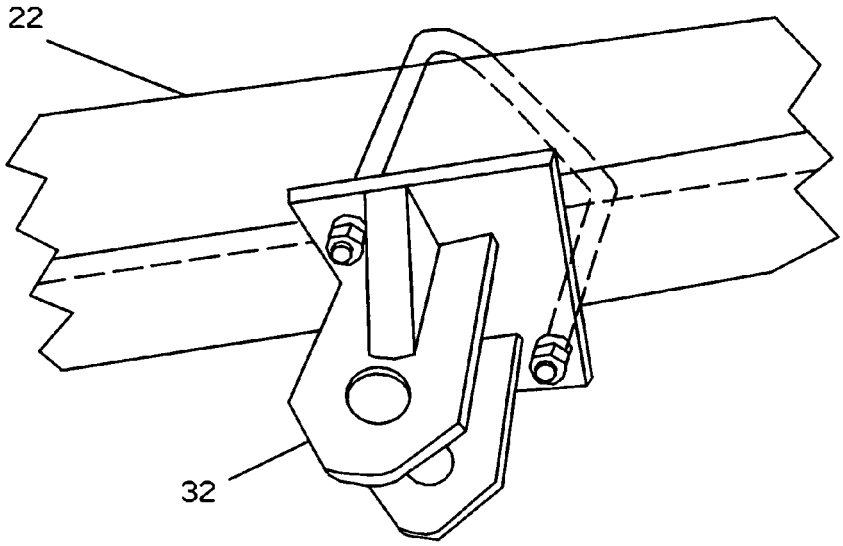
FIG. 5 is a view of a view of a mounting bracket on the crane boom for mounting the gearbox to the boom.
Figure 6:
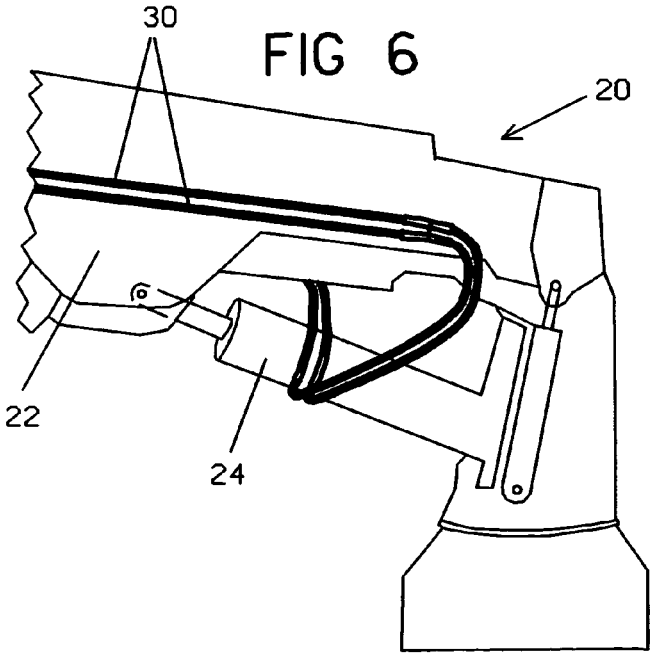
FIG. 6 is a view of the connection of high capacity hydraulic lines mounted on the crane boom for driving the earth boring bit.
Figure 7:
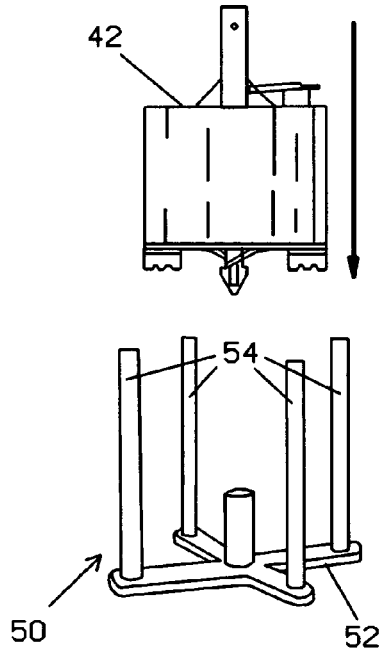
FIG. 7 is a view of the stand used to position the earth boring bit on the truck shown in FIG. 1 and for positioning the earth boring bit in position for connecting the gear box and earth boring bit to the crane.
Figure 8:
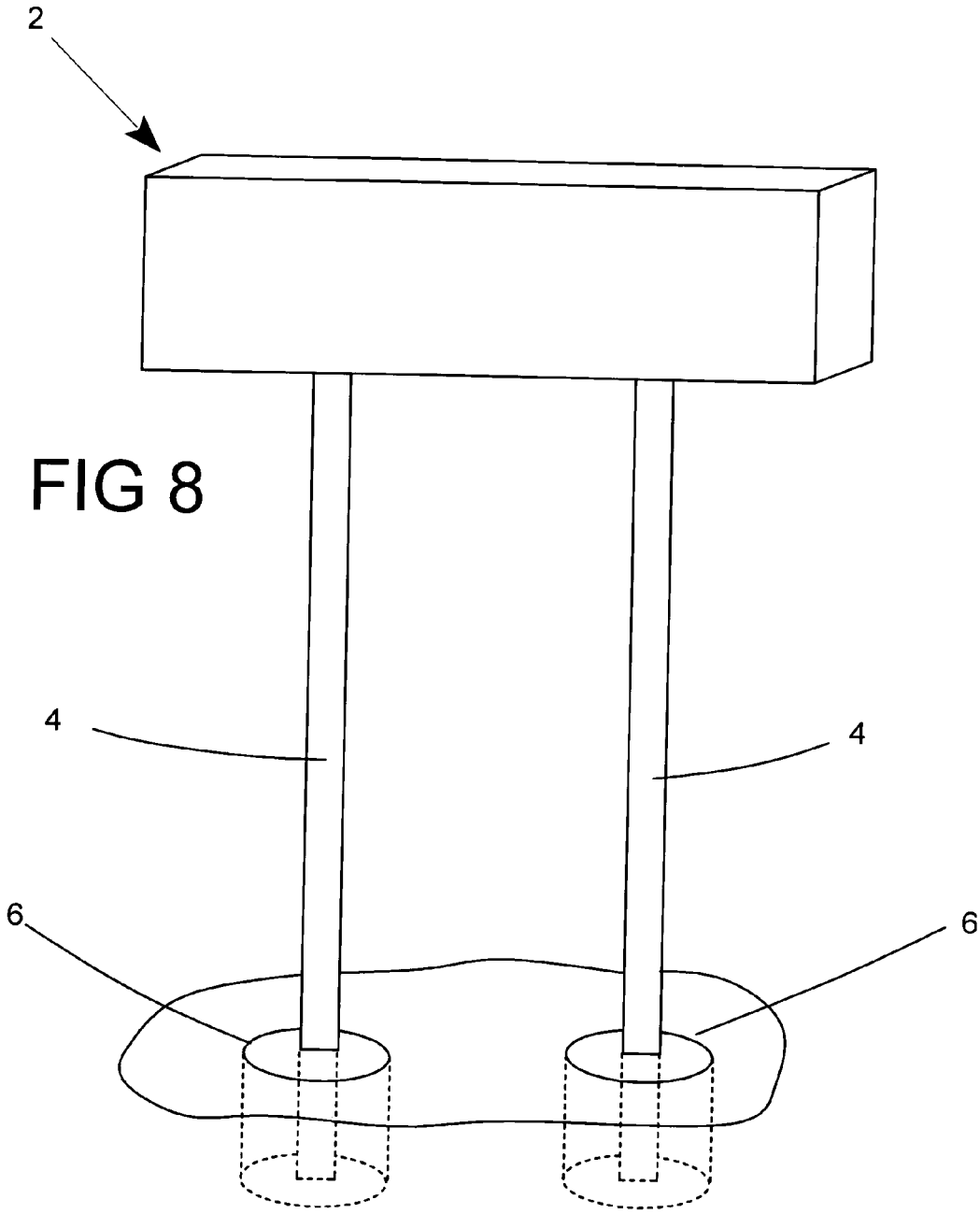
FIG. 8 shows and outdoor sign of the type that can be erected by the single vehicle described herein.

The earth boring bit apparatus 40 comprising the earth boring bit 42, the gearbox 60 and an extension shaft or segment 62 can be attached to the crane 20 at the site where a sign or other elevated structure is to be erected. The earth boring bit 42, the gearbox 60 and the extension segment 62 can be transported on the crane truck 10 in their disassembled configuration. In the preferred embodiment of this invention, a standard Model X2475 gearbox, manufactured by McMillen is employed. In the preferred embodiment of this invention, the gearbox 60 with the extension segment attached has a combined height of approximately thirteen feet. The preferred embodiment of this invention is capable of excavating a hole to a depth of up to eleven feet. To assemble the various components at the job site, the crane is first used to remove the earth boring bit 42 from its stored position on the truck. A load line extending from the end of the crane is attached to the bit shaft 45 and the bit 42 and its stand are lowered from the truck and placed on the ground adjacent to the truck. In order to avoid complications in assembling the earth boring bit apparatus 40, the bit 42, in its stand 52 should be placed on a level surface. The extension shaft 62 is attached to the gearbox 60, and this assembly is then raised by the crane after attaching the load line to the gearbox assembly. The gearbox assembly is then moved into position over the earth boring bit 42 and the extension segment 62 is then mated to the shaft 45 on the earth boring bit 42. A mounting bracket 32, attached to the end of the crane 20, as shown in FIG. 5, comprising the means for physically attaching the earth boring apparatus 40 to the crane 20. A gearbox coupling 64, located at the top of the gearbox 60 is aligned with the mounting bracket 32, and a pin (not shown) is used to physically attach the earth boring bit apparatus 40 to the crane 20. Standard hydraulic connectors 66 attached to the gearbox 60 are mated with hydraulic connectors on the hydraulic lines 30 adjacent the remote or upper end of the crane or boom 20. The hydraulic lines 30 are also attached to the hydraulic system at the opposite end of the hydraulic lines 30 at the base of the crane 20. In the preferred embodiment hydraulic lines, which are normally used to manipulate the hoist or load line are disconnected in order to connect the lines 30 extending to the top of the crane. The earth boring bit apparatus 20 is now connected to the sign truck's hydraulic system, since the hoist or load line is not needed to operate the earth boring bit. The earth boring bit apparatus 20 is then moved to the exact location at which a hole is to be excavated. The hydraulic system causes the earth boring bit 42 to rotate, excavating a hole to a desired depth. Since the earth or debris removed in boring the hole is collected in the closed drum 44, it can be removed from the excavated hole by the crane 20 and placed at a collection point or collection receptacle.

After the hole has been excavated, the earth boring bit apparatus 40 can be dissembled and returned to its storage and transportation position on the sign truck 10. It should be noted that more than one earth boring bit 42 can be stored and transported on the same truck. The earth boring bit 42 is stored and transported in a stand 50, which is removable from the truck 10 along with the bit 42. Stand 50 comprises means for holding the bit 42 in an upright position, both during storage and transportation and when the bit 42 is placed on a level surface for assembly to the gearbox 60, and gearbox extension segment 62 to prepare to bore a hole. Stand 60 includes a base 52, which in the preferred embodiment of the invention comprises a cross configuration formed of metal beams having a sufficient strength to support the bit 42. Arms 54 extend upward from each of the beams forming the stand base 52. These arms 54 are spaced apart so that the earth boring bit 42 can be placed between the four arms 54, and the arms will hold the bit 42 in an upright position. A central projection 56 extends upward form the middle of the base 52, where the beams cross. This central projection 56 extend upward to support the bit base 46 so that the cutting teeth 48 and other components extending beyond the bit base 46 are not damaged during storage or transportation. Earth boring bits 42 are available in different sized having different outer diameters for boring different size holes. Since the sign truck 10 is intended for use at remote locations, it is often desirable to have bits 42 of different sizes available for different jobs.

Once the earth boring bit apparatus 40 has been disconnected from the end of the crane 20, the crane 20 can be used in a conventional manner to erect a sign or some other elevated structure. The primary hydraulic lines 26 are reconnected to the hydraulic system, after disconnection of the second or auxiliary lines 30. A load line extending from the end of the crane 20 can be attached to a pole or post 4 that will support the sign 2 at a raised position. A lower end of the pole or post 4 is then placed in the previously excavated hole 6, and held in this position as concrete or a quick setting mixture such as Sakrete, is poured into the excavated hole surrounding the pole. Sakrete is a registered trademark of Sakrete Inc. After the concrete or other mixture has hardened to an extent necessary to support the pole 6, other necessary poles can be erected in a similar manner or other portions of the sign can be erected with the use of the crane. Assuming the body of the sign has not been previously attached to the pole or poles 6, this sign body will be raised into position by the crane in a conventional manner and attached to the poles by welding, bolting or some other attachment means. The basket, bucket, or working platform 28 on the end of the crane 20 supports a worker as other operations, such as the installation and connection of electrically wiring and components are completed. The earth boring bit apparatus 40 can be transported on the truck and mounted to the crane 20 without interfering with these other conventional structures that are mounted on the crane. However with the exception of pouring the concrete and other minor tasks which may not necessitate the use of a vehicle, the complete erection of a sign 2 can be accomplished by use of the sign truck 2, and not other vehicles, such as tractors for the excavation of holes and the removal of debris are necessary. It should be understood that while the earth boring bit 42 is the preferred bit for excavation holes according to this invention, other earth boring bits, such as augers, can be employed, even if their use may not be as efficient. It should also be understood that other crane mounted truck configurations can also be employed. For instance, the crane could be mounted on the front of the truck bed, adjacent the cab, instead of at the rear of the truck. Although the bucket or basket mounted on the end of the crane is a desirable component, its inclusion is not essential. Therefore, this invention is defined by the following claims and is not limited to the representative embodiment depicted herein.

I claim:

1. A method of erecting a post structure having a height in excess of ten feet, using an apparatus including a crane and including a hydraulic system with a source of hydraulic fluid, comprising the steps of:

connecting an earth boring bit in communication with hydraulic lines extending from the source of hydraulic fluid to a remote, top end of the crane;

hydraulically actuating the earth boring bit through the hydraulic line to excavate a hole for erection of the post structure;

removing earth from the hole by employing the crane to lift the earth boring bit from the hole;

disconnecting the earth boring bit from the hydraulic lines; and erecting the post structure in the evacuated hole with the crane, so that only a single crane is employed to both evacuate a hole receiving the post structure and to erect the post structure anchored in the evacuated hole.

2. The method of claim 1 wherein the earth boring bit includes a drum for collecting residue as the earth boring bit evacuates the hole, the drum comprising means for transporting the residue from the hole as the earth boring bit is lifted by the single crane.

3. The method of claim 2 wherein the crane apparatus is mounted on a truck and the earth boring bit is mounted on the same truck when not in use, the method comprising the further step of removing the earth boring bit from the truck with the crane apparatus and placing the earth boring bit on a ground surface, the earth boring bit being attached to the crane after being positioned on the ground surface.

4. The method of claim 2 comprising the further step of lifting a gear box with the crane apparatus and attaching the gear box to the earth boring bit while the earth boring bit is on the ground surface.

5. The method of claim 4 wherein the gear box is connected directly to the hydraulic line adjacent the remote top end of the crane.

6. A method of erecting an outdoor sign at a site distant from an operator's premises using only a single truck equipped with a crane apparatus, the method comprising the steps of:

transporting an earth boring bit apparatus on the truck to the site at which the outdoor sign is to be erected;

at the site, removing the earth boring bit apparatus from the truck with the crane;

connecting the earth boring bit apparatus to hydraulic lines on the crane;

positioning the earth boring bit apparatus, with the crane apparatus, in position for excavating a hole in which the sign is to be placed;

excavating the hole using the earth boring bit apparatus and employing the crane to transport debris from the hole;

disconnecting the earth boring bit apparatus from the crane apparatus after the hole has been excavated; and erecting the outdoor sign and positioning the outdoor sign in the excavated hole using the same crane apparatus employed with the earth boring bit, whereby separate mobile equipment, other than the truck equipped with the crane apparatus and the earth boring bit apparatus, is not needed at the site.

7. The method of claim 6 including the step of connecting the earth boring bit apparatus in communication with a hydraulic fluid source on the truck through hydraulic fluid lines on the truck to excavate the hole, the hydraulic fluid source on the truck also comprising means for activating equipment other than the earth boring bit apparatus.

8. The method of claim 7 wherein a gearbox is connected between the crane apparatus and an earth boring bit to form the earth boring bit apparatus, the gearbox being connected directly to the hydraulic fluid source.

9. The method of claim 6 wherein the earth boring bit apparatus is mounted in a stand when carried by the truck, the method including the further step of removing the stand and the earth boring bit apparatus from the truck with the crane prior to attaching the earth boring bit apparatus to the crane.

10. The method of claim 9 including the step of removing the earth boring bit apparatus from the stand with the crane prior to excavating the hole.

11. The method of claim 6 wherein the earth boring bit apparatus includes a drum, the drum comprising means for collecting debris as the hole is excavated, the method including the further step of removing the debris from the hole by lifting the drum with the crane.

12. The method of claim 11 wherein the drum is rotated as the hole is excavated, the drum progressively entering the hole as the hole is excavated.

13. The method of claim 7 wherein a gearbox is transported on the truck separate from the earth boring bit apparatus, the crane being removed from the truck by the crane for assembly to the earth boring bit apparatus.

14. The method of claim 6 wherein a hydraulic system operable at a pressure of 2300 psi with a flow rate of 22 gal/min is employed to activate the earth boring bit apparatus to excavate the hole.

15. The method of claim 6 wherein the height of the outdoor sign is at least ten feet.

16. A truck for use in erecting outdoor signs at locations distant from an operator's premises, the truck including:

a crane;

a hydraulic system including hydraulic lines extending along the crane to a remote top end of the crane;

an earth boring bit transportable on the truck, the earth boring bit being carried separate from the crane; and a gearbox apparatus, including an extension segment, transportable on the truck separate from the crane and the earth boring bit apparatus, the gearbox being attachable between the hydraulic system and to the earth boring bit, so that the earth boring bit may be rotated to excavate a hole in which the outdoor signs are to be erected;

wherein the crane comprises means for assembling the gearbox to the earth boring bit apparatus.

17. The truck of claim 16 further including a stand for carrying the earth boring bit in an upright position on the truck.

18. The truck of claim 17 wherein the stand and the earth boring bit are removable from the truck by the crane as a single subassembly.

19. The truck of claim 16 wherein a pair of hydraulic lines extend from a base of the crane toward an end of the crane, the pair hydraulic lines including connectors for disconnecting the pair of hydraulic lines adjacent the base of the crane.

20. The truck of claim 19 wherein the hydraulic lines extending from the base toward the end of the crane has sufficient capacity for a hydraulic fluid flow rate of 22 gal/min at a pressure of 2300 psi.

* * * * *